US011930899B2

(12) United States Patent
Wu et al.

(10) Patent No.: US 11,930,899 B2
(45) Date of Patent: Mar. 19, 2024

(54) TIP ASSEMBLY OF UMBRELLA

(71) Applicants: Chyi-Fong Wu, New Taipei (TW); Chi-Hua Wu, New Taipei (TW)

(72) Inventors: Tsun-Zong Wu, New Taipei (TW); Hsien-Jung Chen, New Taipei (TW)

(73) Assignees: Chyi-Fong Wu, New Taipei (TW); Chi-Hua Wu, New Taipel (TW)

( * ) Notice: Subject to any disclaimer, the term of this patent is extended or adjusted under 35 U.S.C. 154(b) by 138 days.

(21) Appl. No.: 17/568,945

(22) Filed: Jan. 5, 2022

(65) Prior Publication Data

US 2022/0369775 A1 Nov. 24, 2022

(30) Foreign Application Priority Data

May 19, 2021 (TW) ..... 110205741

(51) Int. Cl.

| | |
|---|---|
| ***A45B 25/02*** | (2006.01) |
| ***A45B 19/10*** | (2006.01) |
| ***A45B 25/10*** | (2006.01) |
| ***A45B 25/18*** | (2006.01) |

(52) U.S. Cl.

CPC ..... *A45B 25/02* (2013.01); *A45B 19/10* (2013.01); *A45B 25/10* (2013.01)

(58) Field of Classification Search

CPC ..... A45B 225/18; A45B 25/18
USPC ..... 135/33.5
See application file for complete search history.

(56) References Cited

U.S. PATENT DOCUMENTS

| | | | | |
|---|---|---|---|---|
| 2,185,587 | A * | 1/1940 | Richard | A45B 25/02 135/33.5 |
| 5,694,958 | A * | 12/1997 | Chang | A45B 25/18 135/31 |
| 8,136,541 | B2 * | 3/2012 | Beaulieu | A45B 25/02 135/28 |
| 8,991,412 | B2 * | 3/2015 | Holland | E04H 15/28 135/31 |
| 9,668,553 | B2 * | 6/2017 | Haythornthwaite | A45B 25/02 |
| 10,463,122 | B2 * | 11/2019 | Halton | A45B 25/16 |
| 2007/0272288 | A1 * | 11/2007 | Brebner | A45B 25/18 135/33.5 |
| 2012/0180835 | A1 * | 7/2012 | Frost | A45B 25/18 135/44 |

FOREIGN PATENT DOCUMENTS

JP 3227012 U 7/2020

* cited by examiner

*Primary Examiner* — Noah Chandler Hawk
(74) *Attorney, Agent, or Firm* — MUNCY, GEISSLER, OLDS & LOWE, P.C.

(57) ABSTRACT

A tip assembly of an umbrella is revealed. The tip assembly includes a tip rod detachably disposed on a distal end of an outer cylindrical rib of a rib and a protection piece arranged at a distal end of the tip rod. The tip rod is provided with a mounting hole for mounting the distal end of the outer cylindrical rib therein. The protection piece includes a curved outer surface and an inner surface opposite to the outer surface. The outer surface is abutting against respective support ends of a canopy, without exposed outside the canopy. The distal end of the tip rod is located at the inner surface of the protection piece to be protected thereon. Thereby the tip assembly will not have a sharp end or expose outside the canopy while the canopy is extended by the plurality of ribs.

4 Claims, 7 Drawing Sheets

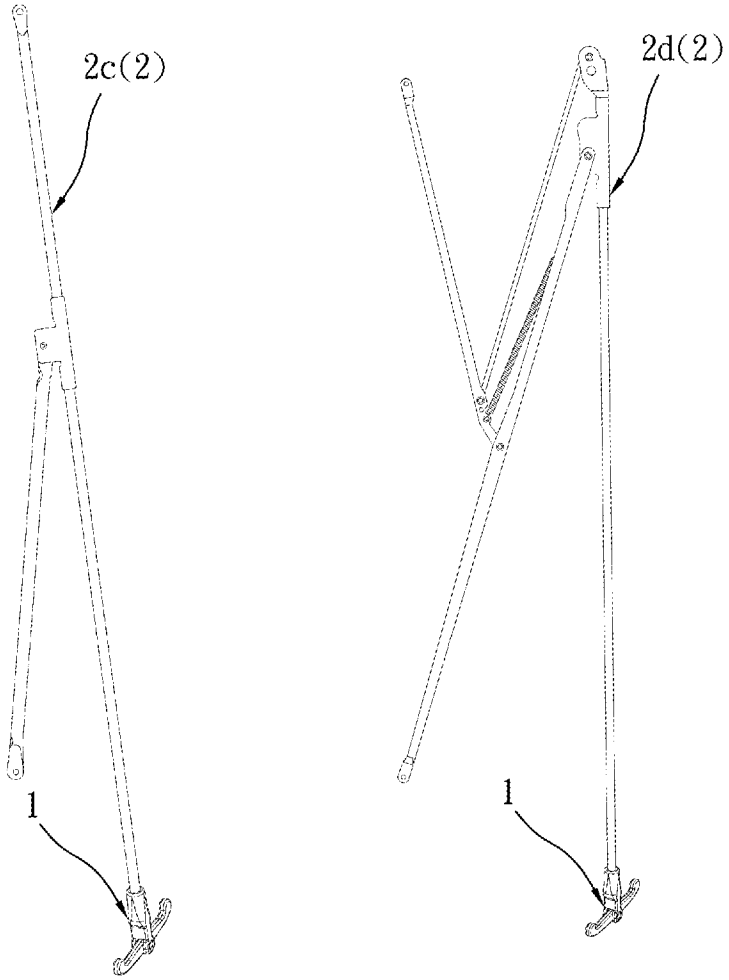
FIG. 5
FIG. 6
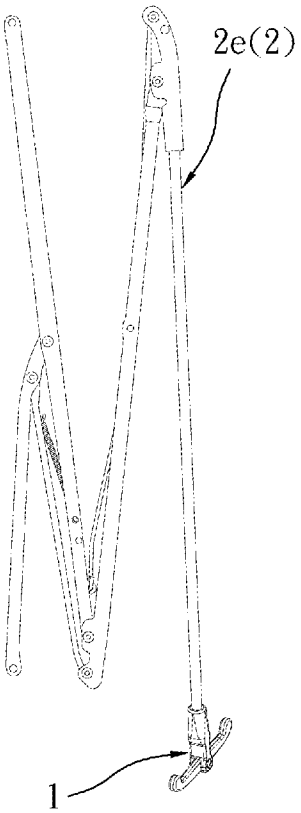
FIG. 7
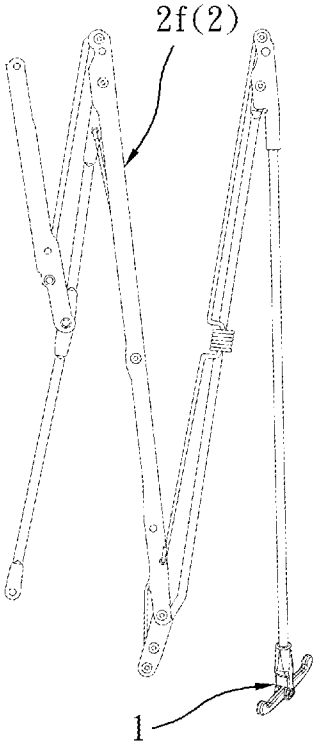
FIG. 8

TIP ASSEMBLY OF UMBRELLA

BACKGROUND OF THE INVENTION

The present invention relates to a tip assembly of an umbrella, especially to a tip assembly of an umbrella with reduced manufacturing cost due to simple structure.

Generally, a ball-shaped tip is mounted to the outermost end (such as outer cylindrical rib or folding rib) of each rib of umbrellas for connection with a canopy conveniently. Yet the tip is exposed and easy to be accidently hit objects or someone. The ribs are easily damaged when the tips are against hard objects. The people may get hurt once the tips spear them. Thus there is an umbrella in which the tips are hidden in and shielded by the canopy, without exposed available on the market now. Refer to JP Pat. No. 3227012 U, a tip 41 is enclosed in a cover fabric 51 shown in FIG. 2, without being exposed. Therefore, people or objects will not get injured or damaged due to the tip exposed.

However, the umbrella mentioned above needs two outer cylindrical ribs 43 with tips 41 for supporting the canopy and against external forces more effectively. Most of such kind of products have complicated structure which lead to higher production cost. Thus there is room for improvement and there is a need to provide a tip assembly with simplified structure for reducing the production cost.

SUMMARY OF THE INVENTION

Therefore, it is a primary object of the present invention to provide a tip assembly of an umbrella, which includes a protection piece disposed on a distal end of a tip rod. The protection piece consists of a curved outer surface and an inner surface opposite to the outer surface. The outer surface is abutting against a support end of a canopy, without exposed outside the canopy. The distal end of the tip rod is located at the inner surface of the protection piece to be protected by the protection piece. Thereby the issue of increased production cost caused by complicated structure of the tip assembly available now can be addressed.

In order to achieve the above object, a tip assembly of an umbrella according to the preset invention is disposed on a distal end of an outer cylindrical rib of a rib. The umbrella includes a plurality of ribs arranged symmetrically around a cap of a shaft and extending outward from the cap. The ribs are disposed radially on a back surface of a canopy so that the canopy is divided into a plurality of panels each of which is having the same area. A support end is formed at an outermost edge of an area between the two adjacent panels. The tip assembly which is used for connection with the canopy and located at the support end includes a tip rod and a protection piece. The tip rod is detachably disposed on the distal end of the outer cylindrical rib of the rib. An inner end of the tip rod is provided with a mounting hole for mounting the distal end of the outer cylindrical rib therein. The protection piece which is arranged at a distal end of the tip rod includes a curved outer surface and an inner surface opposite to the outer surface. The outer surface is abutting against the support end, without exposed outside the canopy. The distal end of the tip rod is located at the inner surface of the protection piece for being protected by the protection piece. Thereby the tip assembly will not have a sharp end or expose outside the canopy when the canopy of the umbrella is supported and extended by the plurality of ribs to be in an open state.

Preferably, the protection piece is detachably arranged at the distal end of the tip rod.

Preferably, the tip rod and the protection piece are connected and integrated by a fastening member which includes a first fastening portion and a second fastening portion. The first fastening portion and the second fastening portion are respectively mounted to the tip rod and the protection piece. The protection piece connected with the tip rod is able to be rotated an angle with respect to the tip rod. When the canopy is affected and deformed due to external factors, the tip rod stays still and the protection piece is rotated along with deformation of the canopy and applied with a force to be in a displaced and strained state. Under such state, the tip rod remains stationary and the protection piece is rotated back to an original position along with the canopy which is returned to an original state while no more affected by the external factors and free from the deformation.

Preferably, the tip rod and the protection piece are connected and integrated by a rivet. The protection piece on the tip rod is able to be rotated an angle with respect to the tip rod. When the canopy is affected and deformed due to external factors, the tip rod stays still and the protection piece is rotated along with deformation of the canopy and applied with a force to be in a displaced and strained state. Under such state, the tip rod remains stationary and the protection piece is rotated back to an original position along with the canopy which is returned to an original state while no more affected by the external factors and free from the deformation.

Preferably, the protection piece is a strip. The protection piece further includes a shaft portion located on a middle part thereof and two symmetrical wing portions. A rear end of the respective wing portions is bent inward.

Preferably, the rib can be non-folding rib, 2-fold rib, 3-fold rib 2*e*, or 4-fold rib.

Preferably, the protection piece and the tip rod are integrally formed.

Preferably, the canopy further includes an edge fabric sewn on the outermost edge of the canopy and a plurality of cover fabric each of which is located on the support end and the back surface of the canopy. The number of the cover fabric is corresponding to the number of the support end and the tip assembly on the support end is covered by the cover fabric.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein:

FIG. 5 is a schematic drawing showing an embodiment of a tip applied to a non-folding rib of a folding umbrella according to the present invention;

FIG. 6 is a schematic drawing showing an embodiment of a tip applied to a 2-fold rib of a folding umbrella according to the present invention;

FIG. 7 is a schematic drawing showing an embodiment of a tip applied to a 3-fold rib of a folding umbrella according to the present invention;

FIG. 8 is a schematic drawing showing an embodiment of a tip applied to a 4-fold rib of a folding umbrella according to the present invention;

DETAILED DESCRIPTION OF THE PREFFERED EMBODIMENT

A structure and technical features of the present invention are described in details in the following embodiments with reference to related figures and reference signs. The size of the respective components shown in figure is not drawn to scale.

Figure 1:
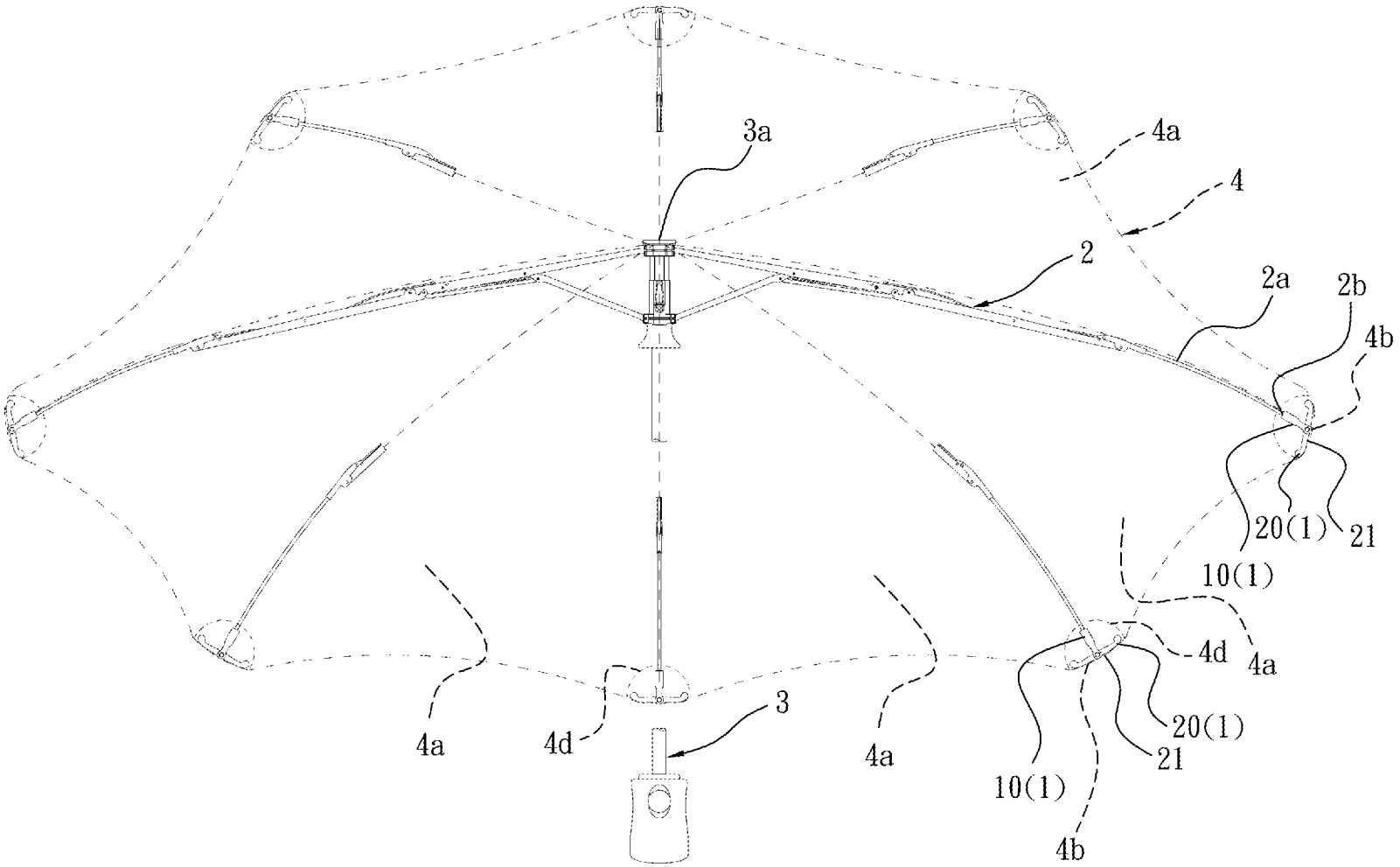
FIG. 1 is a perspective view of an embodiment according to the present invention.
Figure 1B:
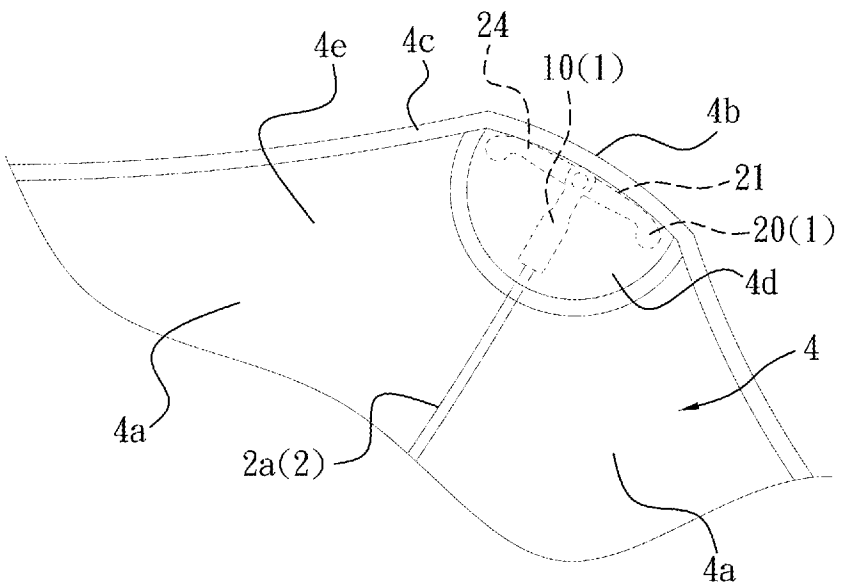
FIG. 1*b* is a schematic drawing showing a back side of the embodiment in FIG. 1*a* according to the present invention.

Refer to FIG. 1, a tip assembly 1 of an umbrella is revealed. The tip assembly 1 is disposed on a distal end 2*b* of an outer cylindrical rib 2*a* of a rib 2, as shown in FIG. 4. There is a plurality of ribs 2 arranged symmetrically around a cap 3*a* of a shaft 3 and extending outward from the cap 3*a*. The ribs 2 are disposed radially on a back surface 4*e* of a canopy 4 so that the canopy 4 is divided into a plurality of panels 4*a* each of which is having the same area. A support end 4*b* is formed at an outermost edge of an area between the two adjacent panels 4*a*. The tip assembly 1 is connected with the canopy 4 and located at the support end 4*b*, as shown in FIG. 1-1*b*. Refer to FIG. 2*a*-3*c*, FIG. 9*a* and FIG. 9*b*, the tip assembly 1 includes a tip rod 10 and a protection piece 20.

The types of the rib 2 includes, but not limited to, non-folding rib 2*c* (as shown in FIG. 5), 2-fold rib 2*d* (as shown in FIG. 6), 3-fold rib 2*e* (as shown in FIG. 7), and 4-fold rib 2*f* (as shown in FIG. 8). Thereby the umbrella has more applications and higher market competitiveness.

Refer to FIG. 1-1*b*, the canopy 4 further includes an edge fabric 4*c* sewn on the outermost edge of the canopy 4 and a plurality of cover fabric 4*d* each of which is located on the support end 4*b* and the back surface 4*e* of the canopy 4. The number of the cover fabric 4*d* is corresponding to the number of the support end 4*b* and the cover fabric 4*d* is used for covering the tip assembly 1 at the support end 4*b*. Thus the tip assembly 1 is enclosed in the cover fabric 4*d*, without exposed.

Figure 2A:
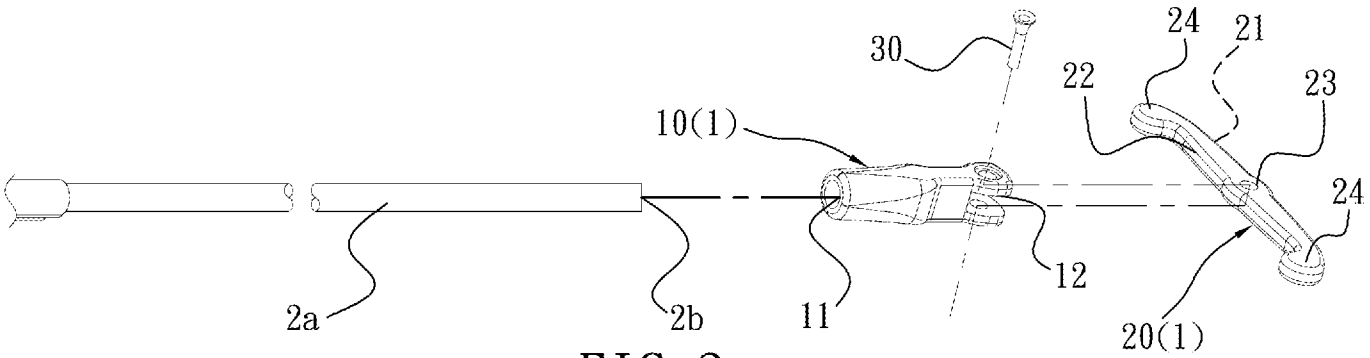
FIG. 2*a* is an exploded view showing a tip rod and a protection piece connected and fixed into one part by a rivet of an embodiment according to the present invention.
Figure 3A:
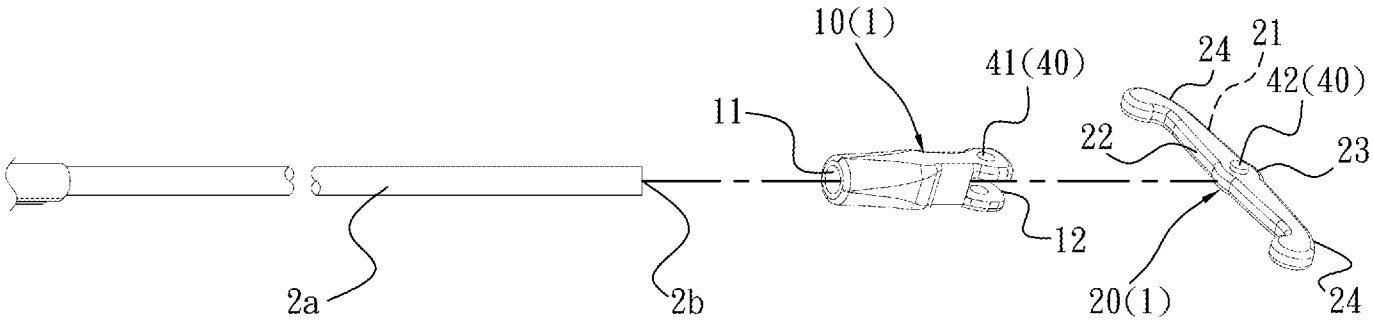
FIG. 3*a* is an exploded view showing a tip rod and a protection piece connected and fixed into one part by a fastening member of an embodiment according to the present invention.
Figure 4:
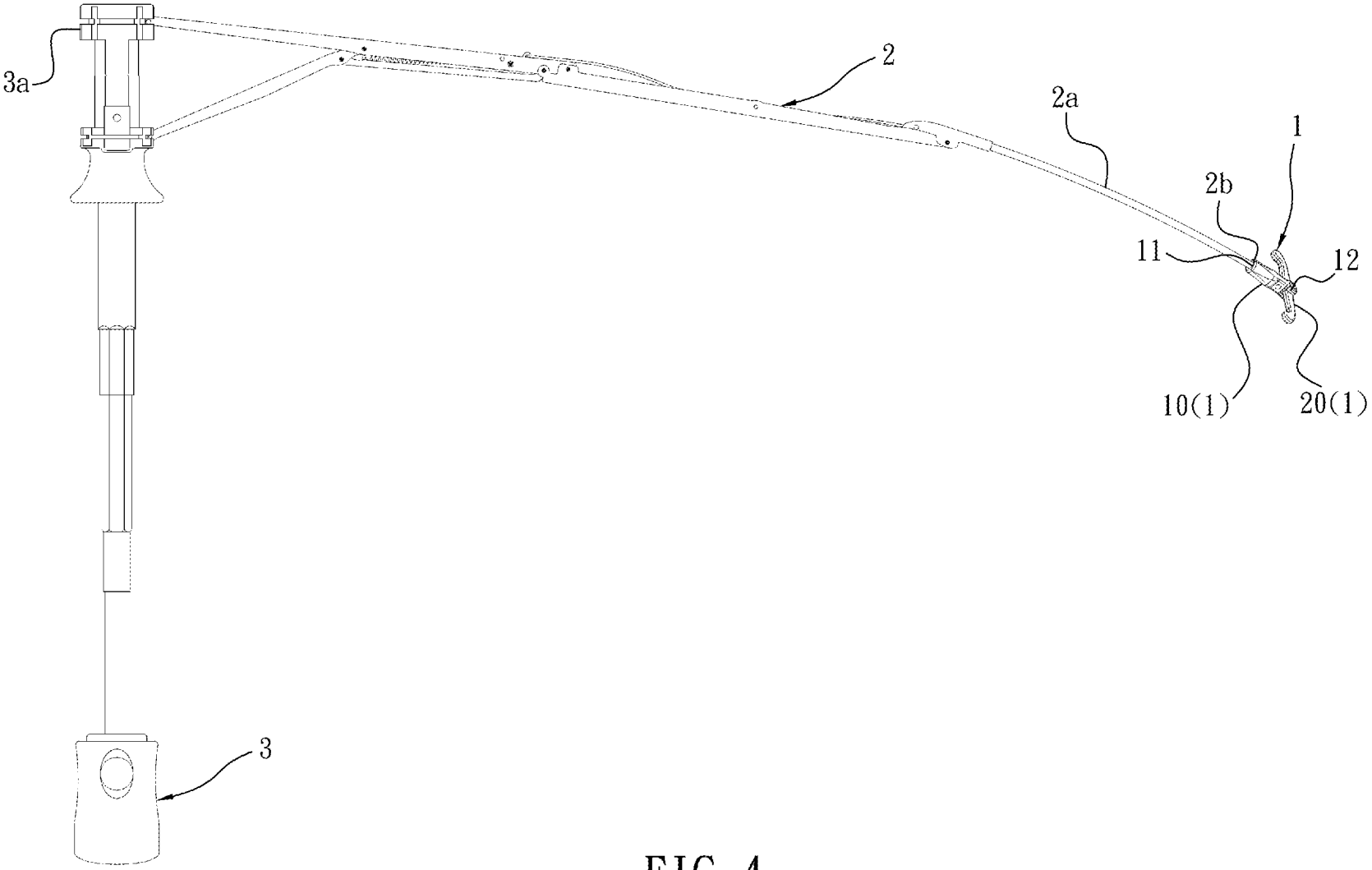
FIG. 4 is a schematic drawing showing an embodiment of a tip applied to a folding umbrella according to the present invention.
Figure 9A:
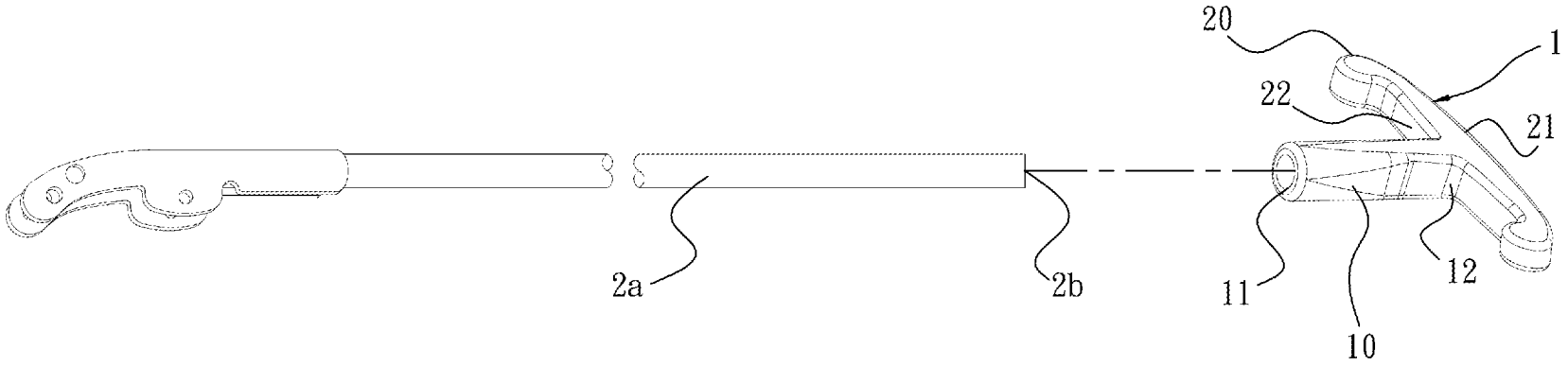
FIG. 9*a* is a partial exploded view showing a tip assembly and a rib of an embodiment according to the present invention.
Figure 9B:
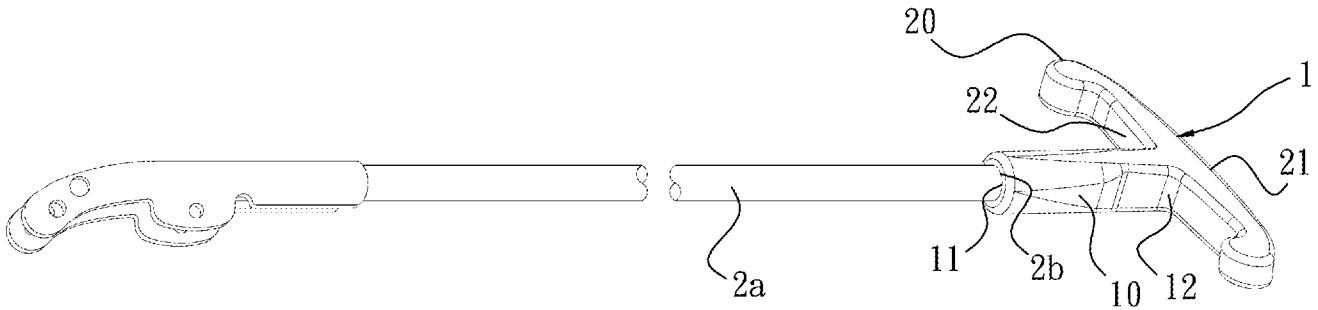
FIG. 9*b* is a perspective view of the embodiment in FIG. 9*a*.

As shown in FIG. 2*a*, FIG. 3*a*, and FIG. 9*b*, the tip rod 10 is detachably disposed on the distal end 2*b* of the outer cylindrical rib 2*a* of the rib 2. An inner end of the tip rod 10 is provided with a mounting hole 11 for mounting the distal end 2*b* of the outer cylindrical rib 2*a* therein.

Figure 2B:
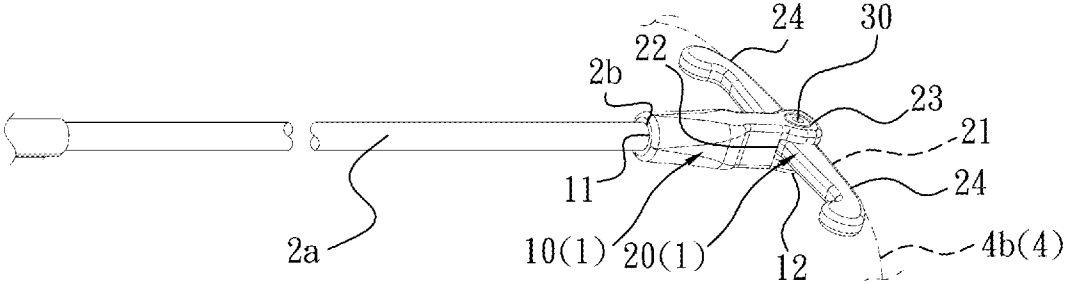
FIG. 2*b* is a perspective view showing an assembly of a tip rod and a protection piece connected by a rivet of an embodiment according to the present invention.
Figure 3B:
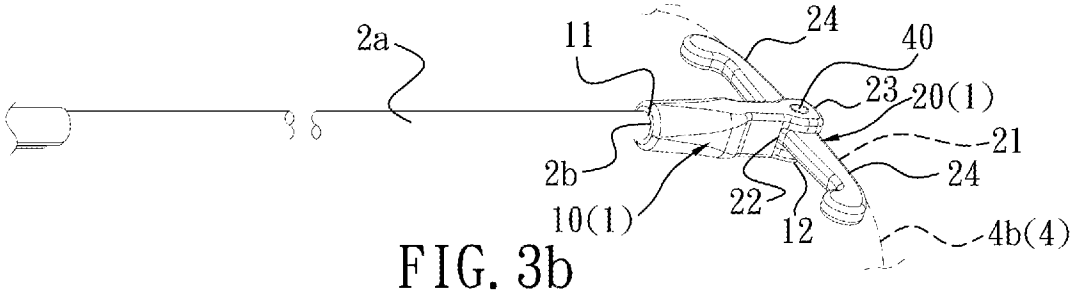
FIG. 3*b* is a perspective view showing an assembly of a tip rod and a protection piece connected by a fastening member of an embodiment according to the present invention.

The protection piece 20 which is arranged at a distal end 12 of the tip rod 10 includes a curved outer surface 21 and an inner surface 22 opposite to the outer surface 21. The outer surface 21 is abutting against the support end 4*b*, without exposed outside the canopy 4, as shown in FIG. 1-1*b*. The distal end 12 of the tip rod 10 is located at the inner surface 22 of the protection piece 20 to be protected by the protection piece 20, as shown in FIG. 2*b*, FIG. 3*b*, and FIG. 9*b*. Thereby the tip assembly 1 will not have a sharp end or expose outside the canopy 4 when the canopy 4 of the umbrella is in an open state due to support and extension of the plurality of ribs 2, as shown in FIG. 1.

Figure 1A:
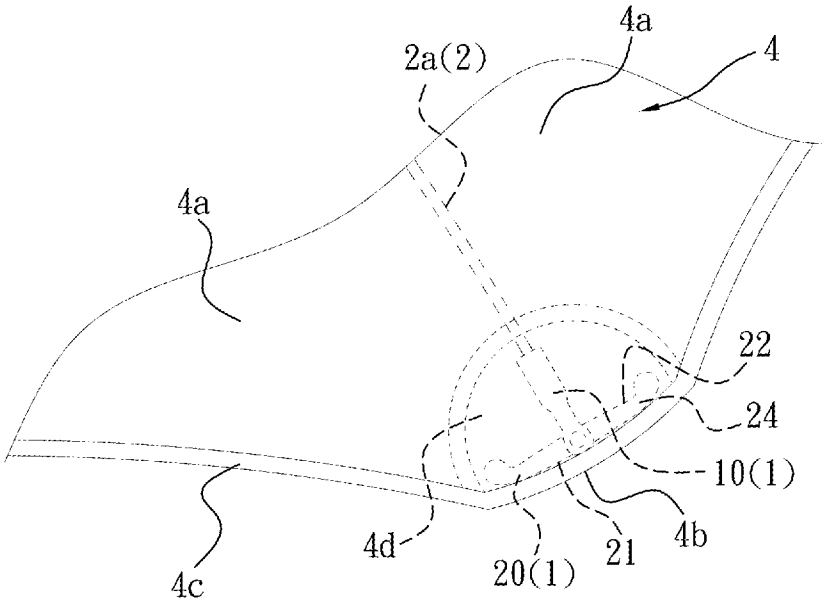
FIG. 1*a* is a partial enlarged view of the embodiment in FIG. 1 (showing a canopy with an edge fabric) according to the present invention.

The protection piece 20 can be, but not limited to, a strip, as shown in FIG. 2*a*-3*c*, FIG. 9*a*, and FIG. 9*b*. The protection piece 20 further includes a shaft portion 23 located on a middle part thereof and two symmetrical wing portions 24, as shown in FIG. 2*a*-3*c*. The tip assembly 1 effectively supports the support end 4*b* of the canopy 4 by the two wing portions 24. A rear end of the wing portion 24 is bent inward for reduction of wear of the canopy 4, as shown in FIG. 1*a*, FIG. 2*b*, and FIG. 3*b*.

According to the ways the tip rod 10 is connected and integrated with the protection piece 20, the tip rod 10 can be designed into different types in order to meet requirements of manufacturers, as shown in the following embodiments, but not limited.

Figure 2C:
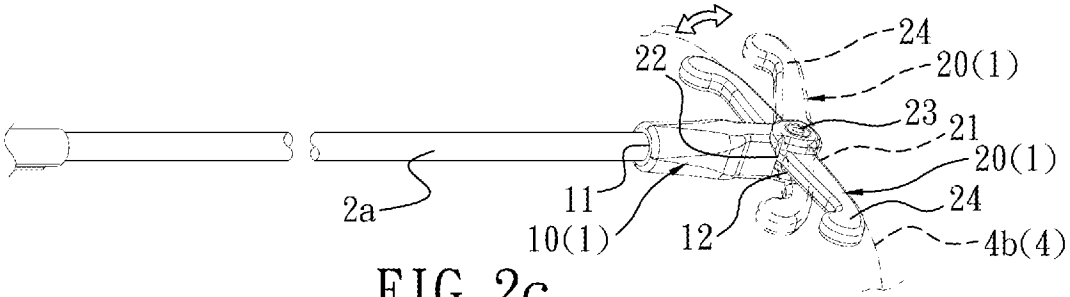
FIG. 2*c* is a schematic drawing showing a protection piece of the embodiment in FIG. 2*b* being rotated an angle according to the present invention.

In the embodiment shown in FIG. 2*a*-2*c*, the protection piece 20 is detachably disposed on the distal end 12 of the tip rod 10 and is connected and integrated with the tip rod 10 by a rivet 30.

As shown in FIG. 2*c*, the protection piece 20 on the tip rod 10 is able to be rotated an angle with respect to the tip rod 10. When the canopy 4 is affected and deformed due to external factors, the tip rod 10 stays put and the protection piece 20 is rotated along with deformation of the canopy 4 and applied with a force to be in a displaced and strained state, as shown in FIG. 2*c*. Under such state, the tip rod 10 remains stationary and the protection piece 20 is rotated back to an original position along with the canopy 4 which is returned to an original state once no more affected by the external factors and free from the deformation. The above design prevents the tip rod 10 and the outer cylindrical rib 2*a* connected with the tip rod 10 from being pulled by the canopy 4 and further avoids the reduction of service life.

Figure 3C:
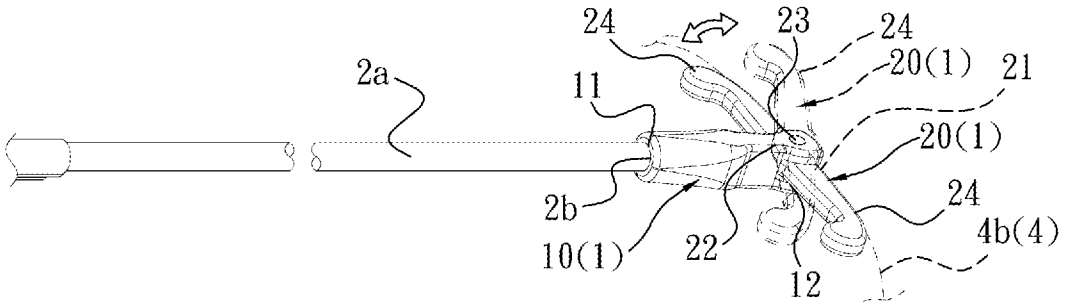
FIG. 3*c* is a schematic drawing showing a protection piece of the embodiment in FIG. 3*b* being rotated an angle according to the present invention.

In the embodiment shown in FIG. 3*a*-3*c*, the protection piece 20 is not only detachably disposed on the distal end 12 of the tip rod 10 but also connected and integrated with the tip rod 10 by a fastening member 40 which includes a first fastening portion 41 and a second fastening portion 42, as shown in FIG. 3*a*. The first fastening portion 41 and the second fastening portion 42 are respectively mounted to the tip rod 10 and the protection piece 20.

As shown in FIG. 3*c*, the protection piece 20 arranged at the tip rod 10 is able to be rotated an angle with respect to the tip rod 10. When the canopy 4 is affected and deformed due to external factors, the tip rod 10 stays still and the protection piece 20 is rotated along with deformation of the canopy 4 and applied with a force to be in a displaced and strained state, as shown in FIG. 3*c*. Under such state, the tip rod 10 remains stationary and the protection piece 20 is rotated back to an original position along with the canopy 4 which is returned to an original state while no more affected by the external factors and free from the deformation. The above design prevents the tip rod 10 and the outer cylindrical rib 2*a* connected with the tip rod 10 from being pulled by the canopy 4 and further avoids the reduction of service life.

In the embodiment shown in FIG. 9*a* and FIG. 9*b*, the protection piece 20 and the tip rod 10 are integrally formed, but not limited in order to reduce manufacturing cost.

Compared with the tips available now, the tip assembly 1 according to the present invention has the following advantages:

(1) As shown in FIG. 2*b*, FIG. 3*b*, and FIG. 9*b*, the distal end 12 of the tip rod 10 is located at the inner surface 22 of the protection piece 20 to be protected by the protection piece 20. Thereby the tip assembly 1 will not have a sharp end or expose outside the canopy 4 when the canopy 4 of the umbrella is in an open state due to support and extension of the plurality of ribs 2, as shown in FIG. 1. The high cost problem of the tip structure available now caused by complicated structure can be solved.

(2) The protection piece 20 is designed to be able to rotate an angle with respect to the tip rod 10 while being arranged at the tip rod 10, as shown in FIG. 2*c*. When the canopy 4 is affected and deformed due to external factors, the tip rod 10 stays put and the protection piece 20 is rotated along with deformation of the canopy 4 and applied with a force to be in a displaced and strained state, as shown in FIG. 2*c*. Under such state, the tip rod 10 remains stationary and the protection piece 20 is rotated back to an original position along with the canopy 4 which is returned to an original state once no more affected by the external factors and free from deformation. The above design prevents the tip rod 10 and the outer cylindrical rib 2*a* connected with the tip rod 10 from being pulled by the canopy 4 and further avoids the reduction of service life. Therefore, the umbrella is more competitive in the market.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A tip assembly which is disposed on a distal end of an outer cylindrical rib of each of a plurality of ribs of an umbrella comprising a tip rod and a protection piece; the ribs are symmetrically disposed around a cap of a shaft, extending outward from the cap, covered by a back surface of a canopy, and used to radially divide the canopy into a plurality of panels each of which is having the same area; a support end is formed at an outermost edge of an area between the two adjacent panels; wherein the tip assembly is used to connect with the canopy and locate at the support end;

wherein the tip rod is detachably disposed on the distal end of the outer cylindrical rib of the rib while an inner end of the tip rod is provided with a mounting hole for mounting the distal end of the outer cylindrical rib therein;

wherein the protection piece is disposed on a distal end of the tip rod and composed of a curved outer surface and an inner surface opposite to the outer surface; the outer surface is abutting against the support end without exposed outside the canopy; wherein the distal end of the tip rod is located at the inner surface of the protection piece to be protected by the protection piece; thereby the tip assembly will not have a sharp end and expose outside the canopy when the canopy of the umbrella is supported and extended by the plurality of ribs to be in an open state;

wherein the protection piece is detachably arranged at the distal end of the tip rod;

wherein the tip rod and the protection piece are connected and integrated by a fastening member; wherein the fastening member includes a first fastening portion and a second fastening portion which are respectively disposed on the tip rod and the protection piece;

wherein the protection piece disposed on the tip rod is able to be rotated an angle with respect to the tip rod; wherein the tip rod stays still and the protection piece is rotated along with deformation of the canopy and applied with a force to be in a displaced and strained state when the canopy is affected and deformed due to external factors; under the displaced and strained state, the tip rod remains stationary and the protection piece is rotated back to an original position along with the canopy which is returned to an original state while no more affected by the external factors and free from the deformation.

2. The tip assembly as claimed in claim 1, wherein the protection piece is a strip; wherein the protection piece further includes a shaft portion located on a middle part thereof and two symmetrical wing portions; a rear end of each of the wing portions is bent inward.

3. The tip assembly as claimed in claim 1, wherein the rib is selected from the group consisting of non-folding rib, 2-fold rib, 3-fold rib, and 4-fold rib.

4. The tip assembly as claimed in claim 1, wherein the canopy further includes an edge fabric circularly sewn on the outermost edge of the canopy and a plurality of cover fabric each of which is located on the support end and the back surface of the canopy; the number of the cover fabric is corresponding to the number of the support end and the tip assembly on the support end is covered by the cover fabric.

* * * * *